US007654011B2

(12) United States Patent
Ronning et al.

(10) Patent No.: US 7,654,011 B2
(45) Date of Patent: Feb. 2, 2010

(54) TWO-STAGE THERMAL OXIDATION OF DRYER OFFGAS

(75) Inventors: Richard L. Ronning, Overland Park, KS (US); Michael V. Wilson, Overland Park, KS (US)

(73) Assignee: Ronning Engineering Company, Inc., Overland Park, KS (US)

( * ) Notice: Subject to any disclaimer, the term of this patent is extended or adjusted under 35 U.S.C. 154(b) by 22 days.

(21) Appl. No.: 11/953,679

(22) Filed: Dec. 10, 2007

(65) Prior Publication Data

US 2008/0222913 A1 Sep. 18, 2008

Related U.S. Application Data

(60) Provisional application No. 60/906,651, filed on Mar. 13, 2007.

(51) Int. Cl.
*F26B 3/02* (2006.01)

(52) U.S. Cl. ..... 34/467; 34/477; 34/487; 34/72; 34/86; 34/219

(58) Field of Classification Search ..... 34/467, 34/471, 476, 477, 478, 487, 72, 84, 86, 218, 34/219

See application file for complete search history.

(56) References Cited

U.S. PATENT DOCUMENTS 5,983,521 A * 11/1999 Thompson ..... 34/467

* cited by examiner

*Primary Examiner*—Jiping Lu
(74) *Attorney, Agent, or Firm*—Hovey Williams LLP

(57) ABSTRACT

A method and apparatus are provided for reducing the VOC, CO, and, alternatively, the NOx content of dryer offgas that is discharged into the atmosphere from a moist organic product drying process using thermal oxidizing apparatus that includes a burner, furnace, mixing chamber, thermal oxidizer, tempering chamber, and an indirect gas-to-gas heat exchanger. The dryer offgas is separated into two portions, with a larger portion being preheated by indirect heat exchange with the hot gaseous output from the thermal oxidizer. The non-preheated portion is directed to the burner in the function of flue gas recycle for NOx control. The preheated portion is separated into two portions, with one portion being directed to the furnace/mixing chamber of the thermal oxidizing apparatus. The other portion of the preheated offgas is recycled to the hot gas inlet of the dryer and serves the function of dryer heat transfer media. Ultimately, all the dryer offgas enters the thermal oxidizer, and comprises a smaller non-preheated portion directed to the burner and a larger preheated portion directed to the furnace/mixing chamber. By preheating a large proportion of the offgas directed to the thermal oxidizing apparatus, simultaneous achievement of an adequate thermal oxidizer temperature, 1600° F., and an adequate oxygen concentration of 5% by volume is achieved for optimized thermal oxidation of carbon monoxide and volatile organic compounds.

22 Claims, 5 Drawing Sheets

1-STAGE THERMAL OXIDATION OF DRYER OFFGAS

1-STAGE THERMAL OXIDATION OF DRYER OFFGAS

1-STAGE THERMAL OXIDATION OF DRYER OFFGAS

2-STAGE THERMAL OXIDATION OF DRYER OFFGAS

TWO-STAGE THERMAL OXIDATION OF DRYER OFFGAS

CROSS-REFERENCE TO RELATED APPLICATION

The present non-provisional application claims the benefit of U.S. Provisional Patent Application No. 60/906,651, entitled TWO-STAGE THERMAL OXIDATION OF DRYER OFFGAS, filed Mar. 13, 2007, which is specifically incorporated herein by reference thereto.

BACKGROUND OF THE INVENTION

1. Field of the Invention

This invention relates to a method and equipment for reducing contaminants such as volatile organic compounds (VOC's) and carbon monoxide (CO) normally present in dryer offgas that is discharged into the atmosphere from a moist organic product drying process. The equipment includes a product dryer, recuperative thermal oxidizing apparatus, a furnace having a burner, which serves to deliver hot products of combustion to the thermal oxidizing apparatus, and a gas-to-gas heat exchanger of the indirect type having a hot gas side and a cool gas side, hereinafter referred to as the primary heat exchanger, for bringing the hot gaseous output from the thermal oxidizing apparatus that is ultimately discharged into the atmosphere into indirect heat exchange relationship with recycle dryer offgas to increase the temperature of the recycle dryer offgas prior to its reentry into the dryer.

Efficient thermal oxidation of VOC's and CO requires correlation of four factors occurring simultaneously:

1) Adequate temperature;
2) Adequate oxygen concentration;
3) Adequate residence time; and
4) Adequate turbulence.

In the present process, a non-preheated portion of the dryer offgas is directed to the burner, while another preheated portion of the dryer offgas that is removed from the stream thereof after passage through the primary heat exchanger is directed to the thermal oxidizing apparatus. The flow rates of the non-preheated portion of the dryer offgas and the preheated portion of the dryer offgas, and the input of fuel to the furnace are controlled and adjusted to provide a hot gaseous output from the thermal oxidizing apparatus that is at a temperature of at least about 1600° F. with an optimum 5% oxygen content by volume, which are sufficiently high to substantially oxidize VOC's and CO in dryer offgas that is discharged into the atmosphere. Introduction of the non-preheated portion of the dryer offgas into the burner also lowers the flame temperature thereby reducing the nitrogen plus oxygen based compounds (NOx's) of the hot products of combustion emanating from the furnace.

2. Description of the Prior Art

Dryers have been used for many years to lower the moisture content of a variety of organic products, such as grain, including distiller's grain and the like, which nominally may have a water content as high as 60-75%. The recent emergence of ethanol plants producing substantial quantities of moist distiller's grain as output residue requiring drying for further commercial use, has rekindled interest in more efficient drying processes while, at the same time, necessitating that dryer offgas discharged into the atmosphere contain reduced amounts of VOC's, CO and NOx's.

Commercial drying equipment has been previously designed and constructed to dry organic products to a predetermined acceptable level, which is normally about 10% moisture by weight, wet basis. It has been known for some time to incorporate thermal oxidizing apparatus in processes and equipment for drying moist organic products in order to lower the VOC and CO content of the product output from the dryer. For systems that utilize recuperative thermal oxidation processes (as opposed to end-of-pipe regenerative thermal oxidation processes) that are similar to one another, these processes have primarily involved the rudimentary steps of bypassing a non-preheated first portion of the dryer offgas to a mixing chamber interposed between a furnace and thermal oxidizing apparatus. A second portion of the offgas has been heat exchanged against the gaseous output from the thermal oxidizer, before being recycled back to the dryer.

In order to reduce the VOC and CO content of dryer offgas introduced into the atmosphere employing a thermal oxidizer, the hot gaseous output from the oxidizer should be at least about 1600° F. and the oxygen concentration should be at least about 5% by volume. Heretofore, the temperature of the output from the thermal oxidizer has been limited to temperatures in the order of 1400° F. when the oxygen concentration is increased to 5% by volume; hence, VOC and CO reduction has not been optimum.

Even though residence time of the offgas being oxidized was not restricted and gas turbulence not a significant factor, it was not heretofore feasible to adequately control both temperature of the thermal oxidizer, and its oxygen concentration, in order to significantly lower the VOC and CO content of the offgas introduced into the atmosphere. The temperature and the oxygen concentration could be controlled individually, but not simultaneously for most efficient operation of the thermal oxidizing apparatus.

FIGS. 1-3 in the drawings hereof are flow diagrams of representative prior art single-stage recuperative thermal oxidation processes where an effort, although only marginally successful, was made to reduce the VOC and CO content of dryer offgas discharged into the atmosphere. A required 1600° F. temperature of the hot gaseous output from the thermal oxidizer could not be obtained to minimize the VOC and CO content using any one of these prior processes.

In the prior art one-stage dryer offgas recuperative thermal oxidation processes of FIGS. 1-3, in each instance, moist organic material was introduced into a dryer with the resultant dried product exiting therefrom. A gaseous medium, consisting primarily of steam generated from the evaporation of product moisture and then superheated in the primary heat exchanger, was introduced into the dryer to reduce the moisture content of the product. The dryer offgas was separated into a first relatively cool portion, while the remaining portion was directed to the cool side of the primary heat exchanger. The preheated gaseous output from the cool side of the primary heat exchanger was then recycled back to the dryer.

The cool offgas portion was directed to a mixing chamber forming a part of conventional recuperative thermal oxidizing equipment that normally included a burner connected to a furnace that, in turn, was connected to a mixing chamber joined to a thermal oxidizer. Alternatively, a portion of the cool offgas directed to the mixing chamber could be redirected to the burner in the function of flue gas recycle for NOx reduction. Sources of natural gas fuel and combustion air were supplied to the burner. The hot gaseous output of the thermal oxidizer, after being directed through a tempering chamber, which reduced the temperature of the gaseous output, was introduced into the hot gas side of the primary heat exchanger. A portion of the hot gaseous output exiting from the hot side of the primary heat exchanger was returned to the tempering chamber, while the remainder of the hot gaseous output exiting from the hot side of the primary heat exchanger was discharged into the atmosphere.

In the system shown in FIG. 1, under the conditions representative of that process, the maximum temperature of the hot gaseous output from the thermal oxidizer was of the order of 1500° F. and the oxygen concentration in the thermal oxidizer was of the order of 2.8% by volume. A modification of the system shown in FIG. 1 is the one-stage system shown in FIG. 2, which provides a larger quantity of combustion air to the burner in an attempt to increase the oxygen content in the gaseous output of the thermal oxidizer. The one-stage system shown in FIG. 2, when operated under the representative conditions of that process, resulted in a thermal oxidizer output temperature of no more than about 1375° F. with an oxygen concentration in the gaseous output of the thermal oxidizer of the order of 5.0% by volume. A modification of the system shown in FIG. 2 is the one-stage system shown in FIG. 3, which adds a combustion air heater in an attempt to increase the outlet temperature of the thermal oxidizer. The one-stage system shown in FIG. 3, when operated under the representative conditions of that process, produced a thermal oxidizer output temperature that did not exceed about 1430° F. with an oxygen concentration in the gaseous output of the thermal oxidizer of the order of 5.0% by volume. Although the improvements described for the systems shown in FIGS. 2 and 3 increased the thermal oxidizer oxygen concentration to the requisite 5.0% by volume, all of these prior art systems had thermal oxidizer output temperatures well below the desirable level of 1600° F. regardless of oxygen concentration.

SUMMARY OF THE INVENTION

The present invention provides a method of significantly reducing the VOC and CO content of dryer offgas that is discharged into the atmosphere from a moist organic product drying process using a recuperative thermal oxidizing apparatus having an input of hot products of combustion from a furnace, along with controlled proportions of non-preheated and preheated dryer offgas, thereby producing a hot gaseous output ultimately destined for atmospheric discharge. Flue gas recirculation (FGR) is used to reduce the NOx content of the burner gases directed into the thermal oxidizer by directing a sufficient quantity of dryer offgas, without preheating thereof into the burner to lower the burner flame temperature thereby limiting NOx production in the burner.

Even where residence time and degree of turbulence are the same in the prior art single-stage recuperative thermal oxidation processes as compared with the two-stage recuperative thermal oxidation of the present invention, simultaneous attainment of adequate temperature and oxygen concentration is not possible in the prior art processes, which is necessary for efficient thermal oxidation. The present two-stage design solves this dilemma.

In the preferred method of this invention, the dryer offgas is separated into first and second portions with the first portion thereof being directed to the burner of the furnace connected to the thermal oxidizer. The second portion of the dryer offgas is preheated by bringing that portion into indirect heat exchange with the hot gaseous output from the thermal oxidizing apparatus. The preheated dryer offgas is separated into two portions with the larger portion recycled back to the dryer and the smaller portion directed to the mixing chamber of the thermal oxidizer.

The non-preheated portion of dryer offgas is directed to the burner along with fuel and combustion air, whereby the hot products of combustion from the furnace have a limited NOx content. An amount of the preheated dryer offgas is removed from the primary heat exchanger output and mixed with the hot products of combustion emanating from the furnace. The quantities of fuel and combustion air supplied to the burner, the relative quantities of non-preheated offgas used for NOx control and preheated offgas directed to the mixing chamber, and the temperature of the preheated offgas directed to the mixing chamber are all closely controlled and correlated to assure that the temperature of the hot gaseous output from the thermal oxidizing apparatus is at least about 1600° F. with an oxygen concentration of at least about 5.0%. In particular, it is preferred that the weighted average temperature of the non-preheated offgas used for NOx control and preheated offgas directed to the mixing chamber be of the order of 600-650° F. Alternatively, a portion of the controlled quantity of combustion air may be injected into the furnace or mixing chamber.

It is also preferred that the hot gaseous output from the thermal oxidizing apparatus be directed through a tempering chamber to somewhat reduce the temperature of the hot gaseous output before introduction into the hot side of the primary heat exchanger that preheats the second portion of the dryer offgas.

Introduction of a controlled proportion of non-preheated dryer offgas into the burner maintains the temperature of the furnace gases at a low enough level that thermal NOx production by the burner is limited. In order to maximize the weighted average temperature of the dryer offgas entering the thermal oxidation process, thus resulting in the highest possible outlet temperature from the thermal oxidizer, the quantity of the non-preheated portion of the dryer offgas directed to the burner, as compared to the preheated portion of the dryer offgas directed to the mixing chamber, is preferably the minimum needed to meet NOx reduction requirements by the method of flue gas recirculation.

In the preferred process, the temperature of the dryer offgas emerging from the dryer is nominally in the range of 200-250° F. The temperature of non-preheated dryer offgas directed to the burner for NOx control is essentially the same. The temperature of the portion of dryer offgas recycled to the dryer is increased in the cold side of the primary heat exchanger by an amount of about 450-500° F., and preferably to a level of about 650-750° F. Similarly, the temperature of the preheated offgas returned to the thermal oxidizing apparatus is of the order of 650-750° F. The temperature of the hot gaseous output from the thermal oxidizing apparatus is reduced in the tempering chamber to a temperature that is slightly lower than the maximum allowable temperature of the primary heat exchanger. The purpose of this temperature reduction is to protect the primary heat exchanger from damage while allowing the primary heat exchanger to be made from commercially available, reasonably affordable materials.

DETAILED DESCRIPTION OF THE PREFERRED EMBODIMENT

Figures 5, 6, 7:
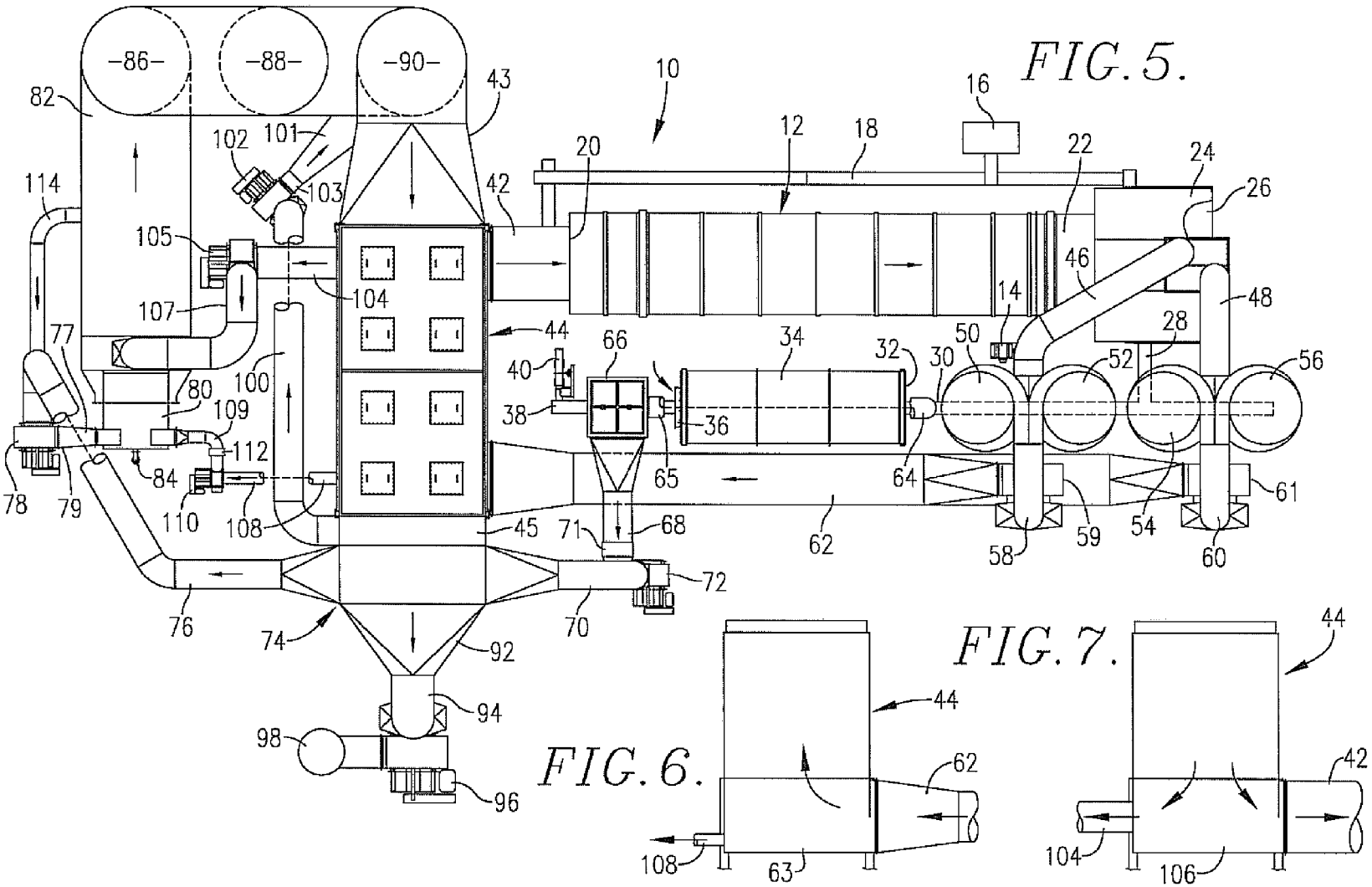
FIG. 5 is a schematic plan view of apparatus for carrying out the preferred dryer offgas treatment process of the present invention.
FIG. 6 is a schematic, vertical, cross-sectional view of one end of the primary heat exchanger illustrating the primary heat exchanger cool gas side inlet plenum and that has a bypass duct which leads to an FGR fan and then to the furnace burner.
FIG. 7 is a schematic, vertical, cross-sectional view through the other end of the primary heat exchanger illustrating the primary heat exchanger cool gas side outlet plenum that is connected to the product dryer and that has a preheated offgas duct, which leads to a vapor injection fan and then to the combination furnace and mixing chamber of the apparatus.

Apparatus for reducing the VOC and CO content of dryer offgas that is discharged into the atmosphere from a moist organic product drying process is shown schematically in FIG. 5 and designated by the numeral 10. The preferred moist product dryer 12 is a cylindrical, single-pass, co-current, three-stage, rotary drum, as illustrated, which is rotated about its longitudinal axis by a motor 14. Alternatively, the dryer may be of the rotary multiple-pass type. Further, the dryer may be of the non-rotating tubular type, or any type that incorporates direct-contact heat exchange between the product to be dried and a hot gaseous heat transfer media. Moist product to be dried is delivered from a schematically-shown source 16 to a conveyor 18 that directs product to the dryer product and gas inlet 20 of dryer 12. The dryer product and gas outlet 22 communicates with a centrifugal separator unit 24. A dropout chamber 26 is interposed between dryer product and gas outlet 22 and centrifugal separator 24, and is located directly below separator 24. A product conveyor 28 is connected to conveyor 30 leading to the cooling drum product inlet and air outlet 32. Cooling drum 34 is a rotatable countercurrent direct contact heat exchanger providing intimate contact between the product and a controlled flow rate of ambient air for the purpose of cooling the product. Air and product travel in axially opposite directions in the cooling drum 34. The cooling drum product outlet and air inlet 36 is connected to a conveyor 38 leading to a bucket elevator 40 that delivers dried product to a suitable collection area (not shown).

Heated gas enters the dryer product and gas inlet 20 through duct 42 joined to the outlet of the cool gas side of an elongated, transversely rectangular, indirect, gas-to-gas heat exchanger herein referred to as the primary heat exchanger 44. The connection of duct 42 to the primary heat exchanger is via the primary heat exchanger cool gas side outlet plenum 106. Dryer offgas exits rotary dryer 12 through dryer product and gas outlet 22 and passes through the dropout chamber 26 to the centrifugal separator 24. The offgas goes overhead from the centrifugal separator 24 via ducts 46 and 48 to suitable cyclone separators. Duct 46 leads to a pair of cyclones 50 and 52, while duct 48 leads to a pair of cyclones 54 and 56. Relatively particle-free offgas exits from cyclones 50-56 through respective ducts 58 and 60. Duct 58 leads to the inlet of recycle fan 59 and duct 60 leads to the inlet of recycle fan 61. The outlets of recycle fans 59 and 61 are transitioned together to a common offgas return duct 62 that leads to the primary heat exchanger cool gas side inlet plenum 63, which communicates with the cool gas side of primary heat exchanger 44 and duct 108 leading to the FGR fan 110.

Except for a relatively small flow rate of dryer offgas that is conveyed through duct 108 to the FOR fan 110 then to the burner 80 via the FGR fan outlet damper 112 and duct 109, the balance of dryer offgas flows from the primary heat exchanger cool gas side inlet plenum 63 into the cool gas side of the primary heat exchanger where this portion of the offgas is substantially heated before exiting the primary heat exchanger into the primary heat exchanger cool gas side outlet plenum 106. Heated dryer offgas emanating from the cool side of the primary heat exchanger and entering the primary heat exchanger cool gas side outlet plenum 106 is divided into two streams. The larger of the two streams emanating from plenum 106 enters the dryer product and gas inlet 20 through duct 42 and repeats the path previously described. The smaller of the two streams emanating from plenum 106 enters the inlet of the vapor injection fan 105 via duct 104, and is then conveyed to the mixing chamber of the combination furnace and mixing chamber 82 via duct 107.

Recycle fans 59 and 61, interposed between ducts 58, 60 and 62, provide the motive forces for circulating dryer heat transfer media and dryer offgas through the cyclones 50-56, the ducts 46, 48, 58, 60, 62 and 42, the cool gas side of primary heat exchanger 44, dryer 12, dropout chamber 26 and centrifugal separator 24. Particulate materials collected by cyclones 50-56 are introduced into the cooling drum product inlet 32 via conveyor 30. Product separated from the gas streams by the dropout chamber 26 and centrifugal separator 24 is conveyed via conveyors 28 and 30 into the cooling drum product inlet 32.

Vapor injection fan 105 provides the motive force for conveying heated dryer offgas from the primary heat exchanger cool gas side outlet plenum 106 to the combination furnace and mixing chamber 82 via ducts 104 and 107.

FGR fan 110 provides the motive force for conveying non-preheated dryer offgas from the primary heat exchanger cool gas side inlet plenum 63 to the burner 80 via ducts 108 and 109 and through FGR fan outlet damper 112.

Air from the atmosphere enters the cooling drum air inlet and product outlet 36, flows through the length of the cooling drum 34, exits from the cooling drum air outlet and product inlet 32 via duct 64 passing over the top of cooling drum 34, and into the dirty gas inlet 65 of bag house 66. Small quantities of particulate matter and moisture become entrained in the air as it passes through the cooling drum 34. Heat is transferred from the hot product to the air as it passes through the cooling drum 34. This heat transfer results in the product being cooled and the air being somewhat warmed. The warmed air is cleaned of particulate matter in bag house 66. The clean, warm air exits bag house 66 and is conveyed by duct 68 to the cooling air fan inlet damper 71, then to the cooling air fan 72, which provides the motive force for moving air through the cooling drum 34, bag house 66, ducts 64 and 68, and cooling air fan inlet damper 71. The clean, warm air exits the cooling air fan 72 and is conveyed via duct 70 to the cool gas side air inlet of an indirect gas-to-gas heat exchanger herein referred to as the combustion air heater 74. The clean, warm air is indirectly heated as it passes through the cool gas side of the combustion air heater 74, which receives heat from hot gases passing through the hot gas side of the combustion air heater, which process is subsequently described. The clean, heated air exits the cool gas side air outlet of the combustion air heater 74 and is conveyed via duct 76 to the combustion air fan 78, then through the combustion air fan outlet damper 79, then to the burner 80 via duct 77. The combustion air fan 78 provides the motive force for moving the air though the combustion air heater 74, the combustion air fan outlet damper 79, the burner 80, and ducts 70, 76 and 77. Fuel, which is typically natural gas, enters the burner 80 via the fuel inlet pipe 84 and the fuel flow rate control valve 85. The fuel and clean, heated air exit the burner 80, and are combusted in the furnace chamber of the combination furnace and mixing chamber 82. Alternatively, fuels other than natural gas can be used including propane, light and heavy fuel oils, and solid fuels.

The hot products of combustion from the furnace chamber and heated dryer offgas from duct 107 enter the mixing chamber of the combination furnace and mixing chamber 82 and are well-mixed therein prior to moving to and through the thermal oxidizer 86. If desired, a second thermal oxidizer 88 may be provided in series flow relationship with the thermal oxidizer 86 to provide additional residence time of the thermal oxidizer process. The hot gaseous output from the thermal oxidizer 88 is conveyed into the tempering chamber 90. A portion of the gas that passes through the hot gas side of the primary heat exchanger 44, is conveyed via ducts 100 and 101 into the tempering chamber 90.

The gaseous products from the thermal oxidizer 88 and duct 11 that separately enter the tempering chamber 90 are well-mixed therein prior to moving into and through the primary heat exchanger hot gas side inlet transition 43 and then into and through the hot gas side of the primary heat exchanger 44 where heat is indirectly transferred from this gaseous mixture to the dryer offgas moving in counterflow direction on the cool gas side of the primary heat exchanger. During this process the gaseous mixture on the hot gas side of the primary heat exchanger 44 is substantially cooled before exiting the hot gas side of the primary heat exchanger into the primary heat exchanger hot gas side outlet plenum 45. The cooled gaseous mixture entering the primary heat exchanger hot gas side outlet plenum 45 is divided into two streams. One stream of the cooled gaseous mixture enters the hot gas side gas inlet of the combustion air heater 74 and is further cooled as heat is indirectly transferred from this gaseous mixture to the combustion air passing through the cool gas side of the combustion air heater. This stream of cooled gaseous mixture exits the hot gas side of the combustion air heater 74, passes through the combustion air heater hot gas side outlet transition 92, duct 94, exhaust fan 96, and exits to atmosphere through the stack 98. The exhaust fan 96 provides the motive force for moving the gaseous products and mixtures through the combination furnace and blending chamber 82, thermal oxidizers 86 and 88, tempering chamber 90, the hot gas side of the primary heat exchanger 44, the hot gas side of the combustion air heater 74, the stack 98, and the associated ducts, plenums and transitions, 43, 45, 92 and 94.

The other stream of the cooled gaseous mixture that emanates from the primary heat exchanger hot gas side outlet plenum 45 enters the tempering fan 102 via duct 100, then passes through the tempering fan outlet damper 103 and into the tempering chamber 90 via duct 101. The flow rate of the cooled gaseous mixture entering the tempering chamber 90 via duct 101 is controlled by the tempering fan outlet damper 103 to regulate the temperature of the gaseous mixture emanating from the tempering chamber to a target temperature that is somewhat lower than the maximum allowable temperature of gases entering the primary heat exchanger 44.

The flow rate of dryer offgas that is conveyed through duct 10 to the burner 80 is controlled by the FGR fan outlet damper 112 as required to regulate and minimize the production of thermal NOx from the burner utilizing the principle of flue gas recirculation. Alternatively, other known technologies can be used to regulate and minimize the production of thermal NOx from the burner.

A supplementary combustion air duct 114, connected between burner 80 and a shroud surrounding furnace and mixing chamber 82 provides a supplemental quantity of combustion air when the quantity provided through duct 76 is insufficient. A portion of the heat emanating from the hot furnace shell is transferred to the supplemental combustion air supply in direct contact with the furnace shell and this quantity of heat is therefore conserved in the process rather than being lost to the environment.

In operation, a moist organic product to be dried, such as grain, including distiller's grain resulting from ethanol production, animal or fish byproducts, municipal sludge, forage materials, or wood byproducts, is directed from source 16 to the conveyor 18 for delivery into the inlet 20 of rotary dryer 12. Dryer offgas that has been substantially heated in the cool gas side of the primary heat exchanger 44 is commingled with the moist product in the rotary dryer 12 in a direct-contact heat exchange process, during which process the moist product receives heat and rejects moisture in the form of steam and the heated dryer offgas rejects heat and is cooled, and integrates the moisture rejected by the product into its composition. The dried product and offgas emitted from the outlet 22 of dryer 12 is delivered into the dropout chamber 26, which separates a large fraction of the dried product from the gaseous content of the dryer output. The offgas emitted from the dropout chamber 26 along with the remaining fraction of entrained dried product moves into the centrifugal separator 24, which separates another fraction of the dried product from the gaseous content. The dried products captured in the dropout chamber 26 and the centrifugal separator 24 enter the dropout chamber conveyor 28 and are conveyed to the cooling drum product inlet 32 by conveyor 30. The dried product output from cooling drum 34 is directed to the bucket elevator 40 by conveyor 38 for removal from apparatus 10.

Figure 4:
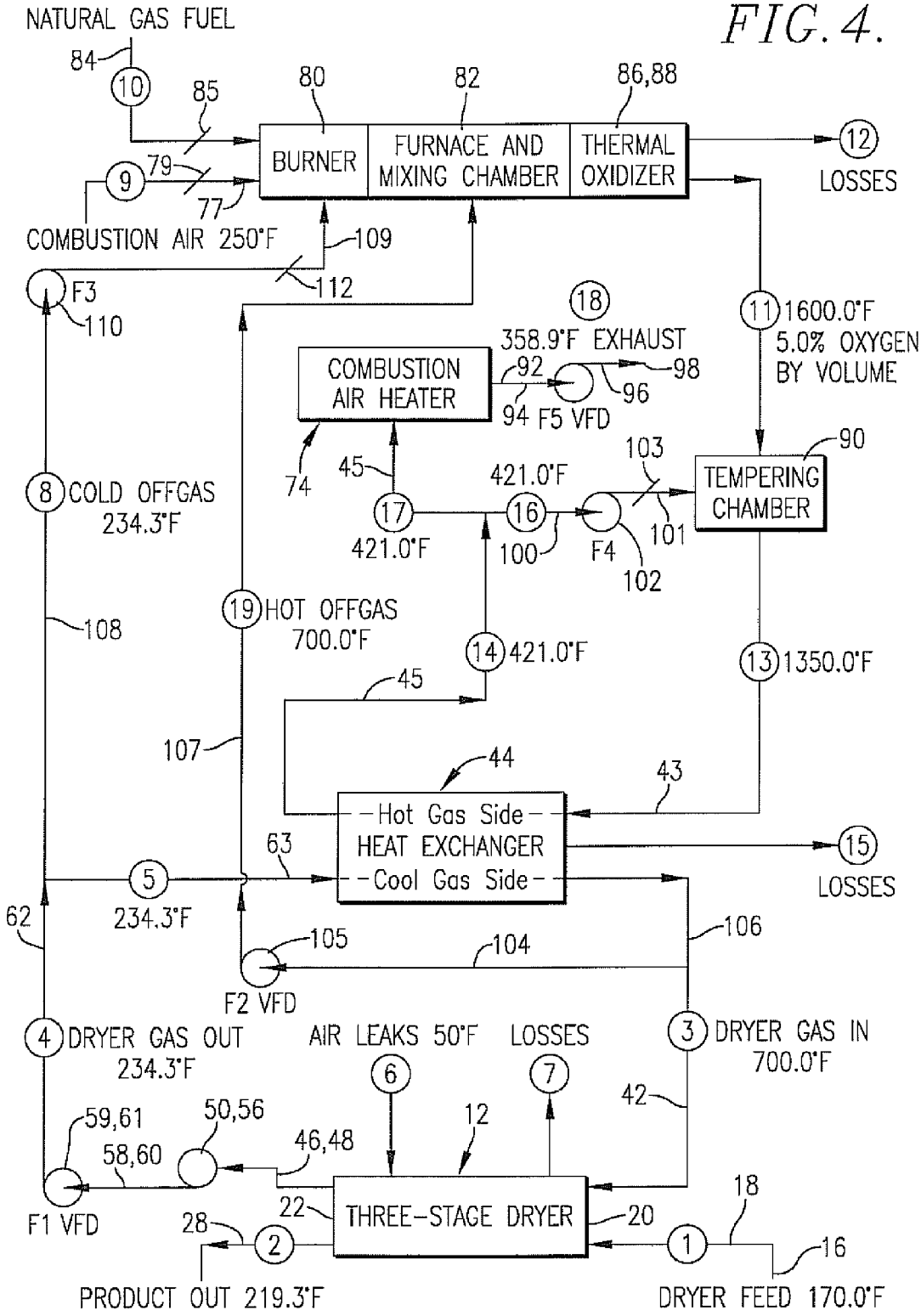
FIG. 4 is a flow diagram of the two-stage recuperative thermal oxidation process of the present invention for treating dryer offgas to remove a greater portion of VOC's and CO in the offgas discharged to the atmosphere than has been previously attainable at a comparable cost.

In an exemplification of a preferred process, as depicted in the flow diagram of FIG. 4, material to be dried directed by conveyor 18 to the three-stage rotary dryer 12 may, for example, be introduced into the dryer at a temperature of 170° F. In the process typified by the flow diagram of FIG. 4, the dried product which is removed by conveyor 28 from dryer drum 12 may, for example, be at a temperature of 219.3° F. The offgas from dryer 12 introduced into the primary heat exchanger 44 via ducts 46, 48, 58, 60 and 62 joined to plenum 63 below the primary heat exchanger 44, may, for example, be at a temperature of 234.3° F. Non-preheated offgas, removed from plenum 63 through duct 108, is conveyed to the burner 80 at the 234.3° F. temperature of the gas in duct 62.

Atmospheric-derived combustion air, nominally at a temperature of about 100° F. after passing through cooling drum 34, and that is introduced into burner 80 through duct 77 and damper 79, preferably is at a temperature of about 250° F. as a result of having been brought into heat exchange relationship in combustion air heater 74 with the hot gaseous output from the primary heat exchanger 44. Use of non-preheated offgas supplied to burner 80 limits the flame temperature of the burner, thereby deterring formation of undesirable NOx compounds.

The heated offgas exiting from the primary heat exchanger 44 through plenum 106 and returned to dryer 12 via duct 42, in the exemplary process of FIG. 4, is at a temperature of 700° F. The quantity and temperature of non-preheated dryer offgas removed from plenum 63 through duct 108 and that is directed to burner 80 via duct 109, the quantity and temperature of preheated dryer offgas that is removed from plenum 106 and directed to the combination furnace and mixing chamber 82 via ducts 104 and 107, the quantity of natural gas, and the quantity and temperature of the combustion air introduced into burner 80, are all controlled such that the hot gaseous output from the thermal oxidizers 86 and 88 leading to tempering chamber 90 is at a temperature of about 1600.0° F. and has an oxygen concentration of 5% by volume, which limits the quantity of VOC's and CO in the hot gaseous output. The temperature of the hot gaseous output from the thermal oxidizers 86 and 88 is reduced in chamber 90 to a temperature of 1350° F. before being directed into the hot gas side of the primary heat exchanger 44. The dryer offgas exiting from the hot gas side of the primary heat exchanger 44, a portion of which enters the hot gas side of the combustion air heater 74, and another portion of which is recycled to the tempering chamber 90 via ducts 100 and 101 is a temperature of 421° F.

Figure 1:
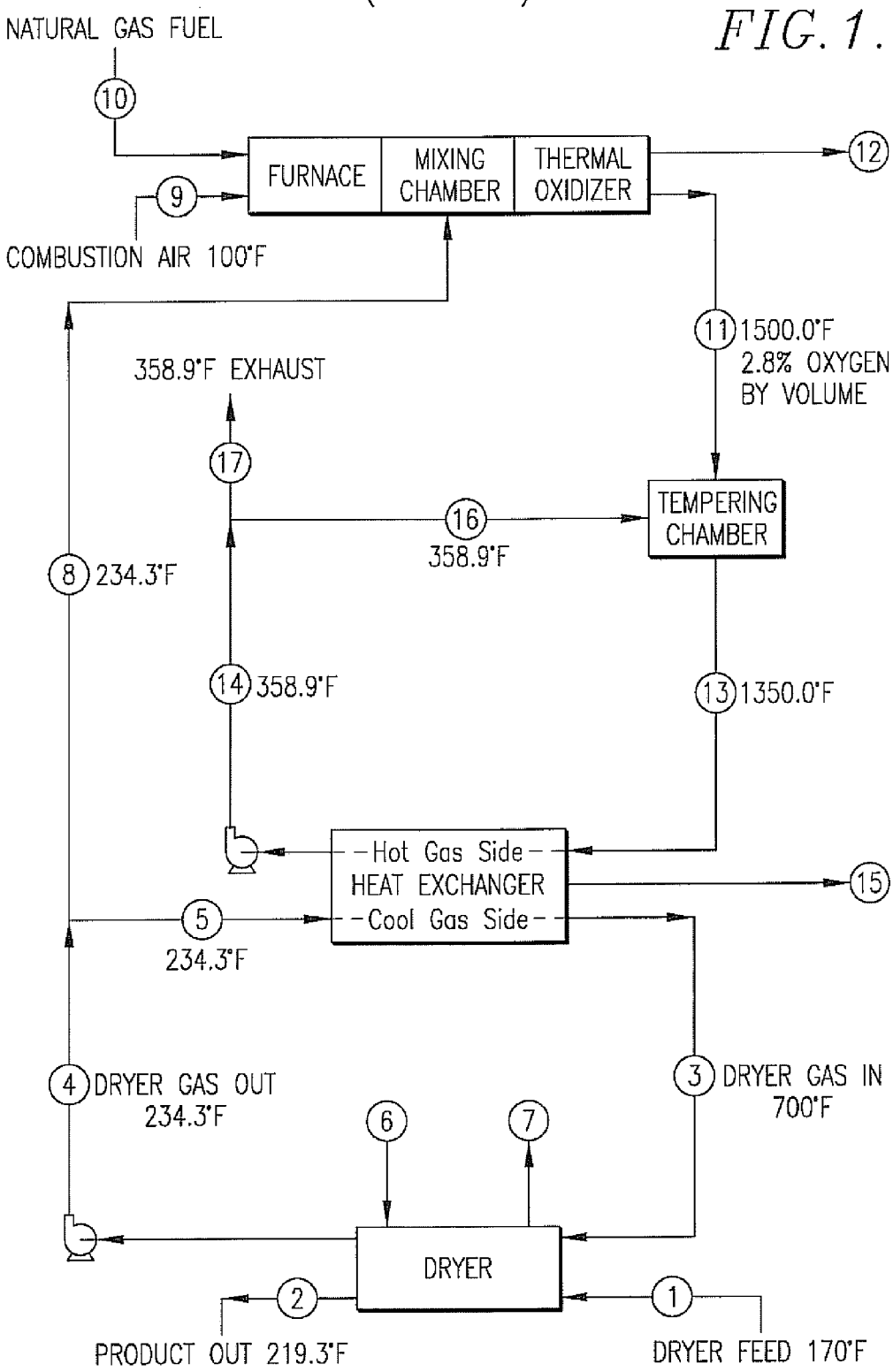
(PRIOR ART) FIG. 1.
FIGS. 1-3 are flow diagrams of prior art single-stage recuperative thermal oxidation processes for treating dryer offgas that have been employed in an effort to reduce the VOC and CO content of the offgas that is discharged to the atmosphere.

In the single-stage prior art process of FIG. 1, the temperature of the gaseous output from the thermal oxidizer is adjusted to 1500° F. by the only reasonable means available reducing the level of excess air supplied to the combustion process. Unfortunately, this results in a thermal oxidizer oxygen concentration of only 2.8% by volume, which is too low for effective thermal oxidation.

Figure 2:
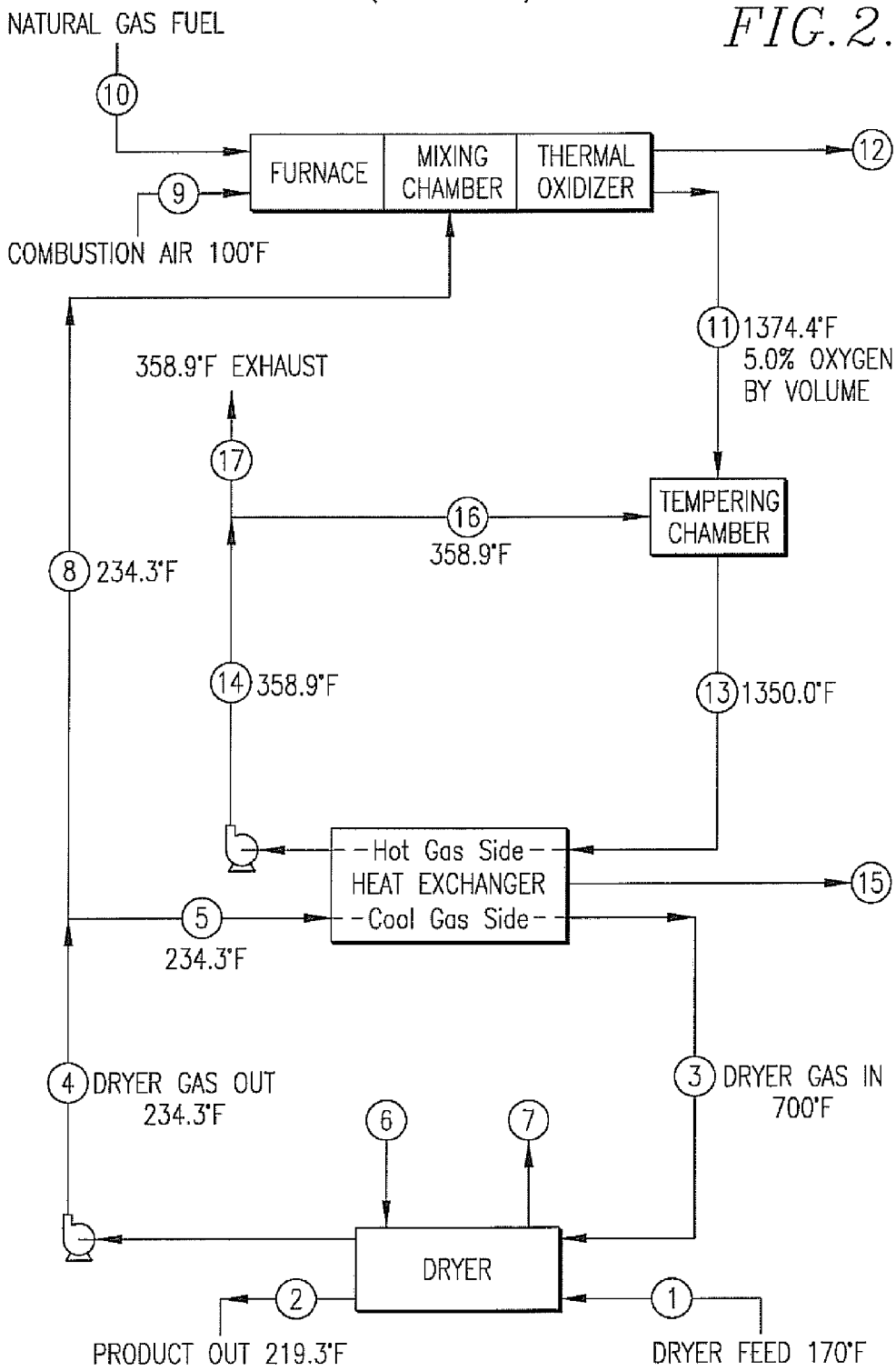
(PRIOR ART) FIG. 2.

In the single-stage prior art process of FIG. 2, the flow rate of combustion air entering the burner is increased for the purpose of raising the oxygen concentration in the thermal oxidizer to 5.0% by volume, which is a satisfactory level where the other three thermal oxidation factors referred to previously are simultaneously adequate. However, this increase in combustion air flow rate also causes the temperature of the hot gaseous output from the thermal oxidizer to decrease to 1374.4° F. This temperature is too low for effective oxidation of carbon monoxide and again shows the dilemma of attempting to adjust the system to simultaneously achieve both an adequate temperature and an adequate oxygen concentration. If the combustion air flow rate increases, the oxygen concentration increases, but the thermal oxidizer temperature decreases to an unacceptably low value.

Figure 3:
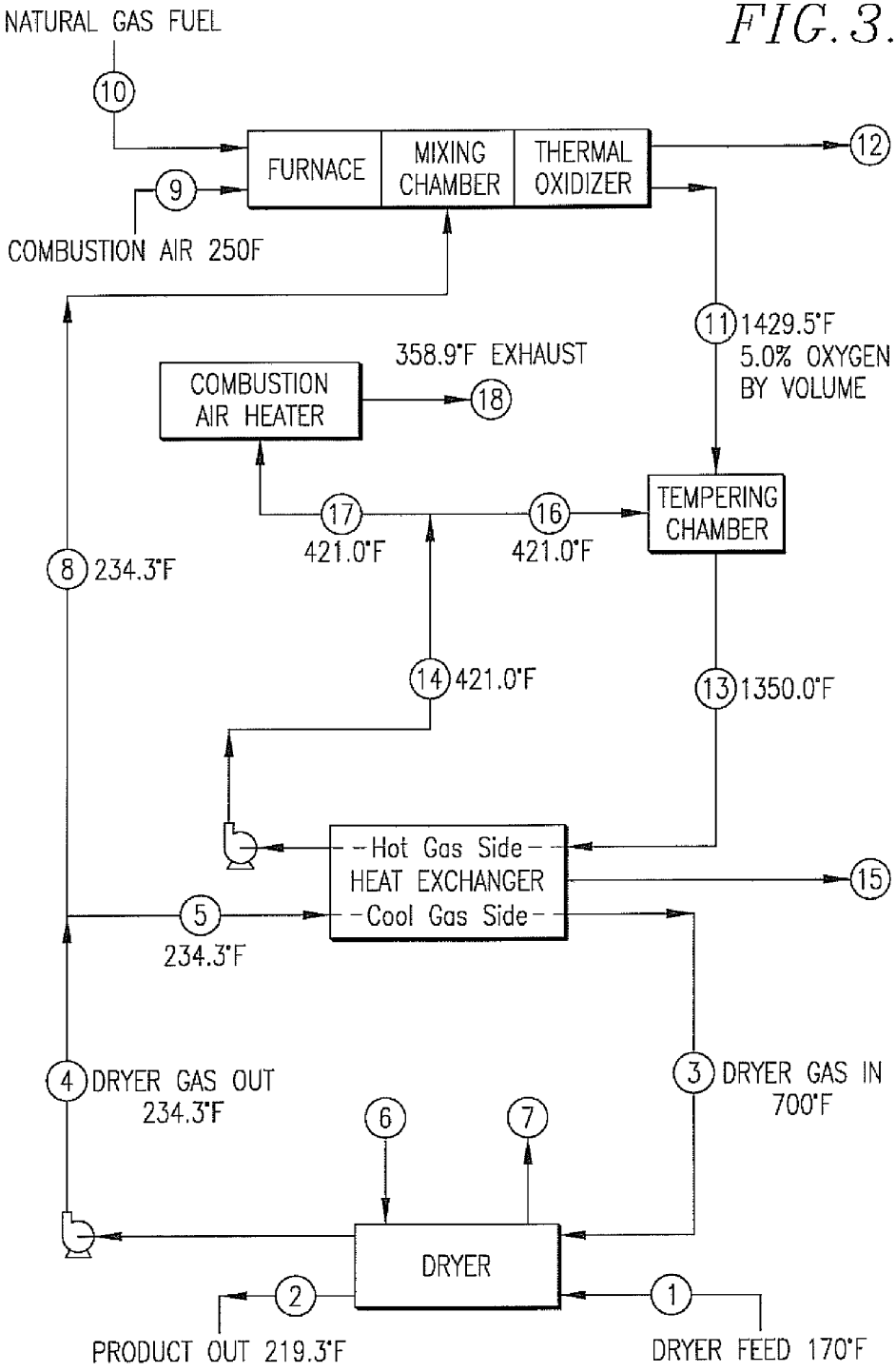
(PRIOR ART) FIG. 3.

In the single-stage prior art process of FIG. 3, a combustion air heater has been added to preheat the combustion air in an attempt to raise the temperature in the thermal oxidizer while maintaining an adequate oxygen concentration of 5.0% by volume. Although the temperature of hot gaseous output from the thermal oxidizer has been increased 55.1° F. to 1429.5° F., this temperature is still too low for effective thermal oxidation of carbon monoxide.

In the two-stage process of this invention, as shown schematically in FIG. 4, if a large fraction (e.g., 80%) of the dryer offgas is directed through the primary heat exchanger to preheat the offgas before being directed to the mixing chamber of the thermal oxidizing apparatus, the result is simultaneous achievement of adequate temperature, 1600° F., and an adequate oxygen concentration of 5.0% by volume for effective thermal oxidation of both CO and VOC's.

The two-stage process of this invention allows selective variation of the relative proportions of non-preheated dryer offgas and preheated dryer offgas introduced into the burner/thermal oxidation apparatus as required to optimize the control of VOC's, CO, and NOx's.

The single-stage thermal oxidation processes of FIGS. 1-3 fail to adequately compensate for deficiencies in temperature and oxygen concentration, whereas the two-stage thermal oxidation system of FIG. 4 overcomes these deficiencies.

In the table below, the common features of the three prior art single-stage thermal oxidation processes of FIGS. 1-3 are compared with the two-stage thermal oxidation process of FIG. 4. In this comparison, all four of the process flow diagrams share the following common features:

1. The dryer processes are identical. All the mass and energy inputs and outputs to and from the dryers are identical.
2. The dryer offgas enters the dryer's furnace/mixing chamber for thermal oxidation of pollutants. This is the furnace that provides the heat that drives the thermal oxidation process and dryer's evaporation process.
3. The offgas mass flow rates of the dryers are identical.
4. The dryers are indirectly fired with a primary heat exchanger between the thermal oxidizer and the dryer. Hot gases from the thermal oxidizer transfer thermal energy to the primary heat exchanger, which transfers this thermal energy to the dryer heat transfer media.
5. The dryer heat transfer media consists primarily of steam, which is the same moisture that has been evaporated from the product being dried.
6. The combustion air source temperatures are identical.
7. The atmospheric exhaust temperatures are identical.
8. The radiation and convection losses from the dryer, thermal oxidizer and primary heat exchanger are identical.
9. The mass flow rates of air leaks into the dryer system are identical.
10. For each of the four systems, the mass flow rates and energy flow rates are thermodynamically balanced within each individual process, which includes the processes of mixing, combustion, separating, heat transfer, and drying.
11. For each of the four systems, the mass flow rates for each individual constituent ($N_2$, $O_2$, CO, $H_2O$) are mathematically balanced within each individual process.

TABLE 1

| | Process Flow Diagrams | | | |
|---|---|---|---|---|
| | A<br>FIG. 1 - Prior Art<br>Single Stage | B<br>FIG. 2 - Prior Art<br>Single Stage | C<br>FIG. 3 - Prior Art<br>Single Stage | D<br>FIG. 4<br>Two Stage |
| 1 | Dryer Feed | | | |
| | 170.0° F.<br>144,000.00 lb/hr - Total<br>66.0000% - Moisture<br>48,960.00 lb/hr - Solids<br>95,040.00 lb/hr - $H_2O$ | Same as A | Same as A | Same as A |
| 2 | Product Out | | | |
| | 219.3° F.<br>54,400.00 lb/hr - Total<br>10.00000% - Moisture<br>48,960.00 lb/hr - Solids<br>5,440.00 lb/hr - $H_2O$ | Same as A | Same as A | Same as A |

TABLE 1-continued

| | Process Flow Diagrams | | | |
|---|---|---|---|---|
| | A<br>FIG. 1 - Prior Art<br>Single Stage | B<br>FIG. 2 - Prior Art<br>Single Stage | C<br>FIG. 3 - Prior Art<br>Single Stage | D<br>FIG. 4<br>Two Stage |
| 3 | Dryer Gas In | | | |
| | 700.0° F.<br>466,569.8 lb/hr - Total<br>59,576.2 lb/hr - $N_2$<br>17,998.6 lb/hr - $O_2$<br>38.8 lb/hr - $CO_2$<br>388,956.2 lb/hr - $H_2O$<br>355,356.7 acfm | Same as A | Same as A | Same as A |
| 4 | Dryer Gas Out | | | |
| | 234.3° F.<br>574,133.2 lb/hr - Total<br>73,310.9 lb/hr - $N_2$<br>22,148.0 lb/hr - $O_2$<br>47.8 lb/hr - $CO_2$<br>478,626.6 lb/hr - $H_2O$<br>204.3° F. - Dewpoint<br>261,692.8 acfm | Same as A | Same as A | Same as A |
| 5 | Dryer Gas to Primary Heat Exchanger | | | |
| | 234.3° F.<br>466,569.8 lb/hr - Total<br>59,576.2 lb/hr - $N_2$<br>17,998.6 lb/hr - $O_2$<br>38.8 lb/hr - $CO_2$<br>388,956.2 lb/hr - $H_2O$<br>212,664.8 acfm | Same as A | Same as A | 234.3° F.<br>552,513.0 lb/hr - Total<br>70,550.2 lb/hr - $N_2$<br>21,314.0 lb/hr - $O_2$<br>46.0 lb/hr - $CO_2$<br>460,602.8 lb/hr - $H_2O$<br>251,838.1 acfm |
| 6 | Dryer Air Leaks | | | |
| | 50° F.<br>32.1° F. - Dewpoint<br>50.0% - Relative Humidity<br>17,963 lb/hr - Total<br>13,735 lb/hr - $N_2$<br>4,149 lb/hr - $O_2$<br>9 lb/hr - $CO_2$<br>70 lb/hr - $H_2O$<br>4,000 acfm | Same as A | Same as A | Same as A |
| 7 | Dryer and Piping Radiation and Convection Losses | | | |
| | 200,000 Btu/hr | Same as A | Same as A | Same as A |
| 8 | Non-Heated Offgas to Burner/Furnace/Mixing Chamber | | | |
| | 234.3° F.<br>107,563.4 lb/hr - Total<br>13,734.7 lb/hr - $N_2$<br>4,149.4 lb/hr - $O_2$<br>8.9 lb/hr - $CO_2$<br>89,670.3 lb/hr - $H_2O$<br>49,027.9 acfm | Same as A | Same as A | 234.3° F.<br>(20.1% of offgas)<br>21,620.2 lb/hr - Total<br>2,760.7 lb/hr - $N_2$<br>834.0 lb/hr - $O_2$<br>1.8 lb/hr - $CO_2$<br>18,023.7 lb/hr - $H_2O$<br>9,854.6 acfm |
| 9 | Combustion Air | | | |
| | Preheated to 100° F.<br>21.40% - Excess Air<br>104,834.6 lb/hr - Total<br>80,156.0 lb/hr - $N_2$<br>24,216.0 lb/hr - $O_2$<br>52.2 lb/hr - $CO_2$<br>410.4 lb/hr - $H_2O$<br>25,634.1 acfm | Preheated to 100° F.<br>65.83% - Excess Air<br>146,756.3 lb/hr - Total<br>112,209.1 lb/hr - $N_2$<br>33,899.6 lb/hr - $O_2$<br>73.1 lb/hr - $CO_2$<br>574.5 lb/hr - $H_2O$<br>35,884.8 acfm | Preheated to 250° F.<br>66.00% - Excess Air<br>146,105.3 lb/hr - Total<br>111,711.4 lb/hr - $N_2$<br>33,749.2 lb/hr - $O_2$<br>72.8 lb/hr - $CO_2$<br>571.9 lb/hr - $H_2O$<br>45,300.6 acfm | Same as C |
| 10 | Natural Gas Fuel | | | |
| | 5,455.1508 lb/hr<br>119,391,431 Btu/hr<br>(HHV) | 5,590.5498 lb/hr<br>122,354,773 Btu/hr<br>(HHV) | 5,560.0527 lb/hr<br>121,687,313 Btu/hr<br>(HHV) | Same as C |
| 11 | Gaseous Output From Thermal Oxidizer | | | |
| | 1500.0° F.<br>217,853.1 lb/hr - Total<br>94,316.8 lb/hr - $N_2$<br>8,418.1 lb/hr - $O_2$<br>13,937.2 lb/hr - $CO_2$<br>101,181.1 lb/hr - $H_2O$<br>0.0 lb/hr - $SO_2$<br>236,200.0 acfm<br>2.7559% v/v $O_2$ | 1374.4° F.<br>259,910.3 lb/hr - Total<br>126,380.5 lb/hr - $N_2$<br>17,606.6 lb/hr - $O_2$<br>14,302.5 lb/hr - $CO_2$<br>101,620.7 lb/hr - $H_2O$<br>0.0 lb/hr - $SO_2$<br>254,828.7 acfm<br>5.0000% v/v $O_2$ | 1429.5° F.<br>259,228.8 lb/hr - Total<br>125,880.4 lb/hr - $N_2$<br>17,567.8 lb/hr - $O_2$<br>14,224.6 lb/hr - $CO_2$<br>101,556.1 lb/hr - $H_2O$<br>0.0 lb/hr - $SO_2$<br>261,905.4 acfm<br>5.0000% v/v $O_2$ | 1600.0° F.<br>259,228.8 lb/hr - Total<br>125,880.4 lb/hr - $N_2$<br>17,567.8 lb/hr - $O_2$<br>14,224.6 lb/hr - $CO_2$<br>101,556.1 lb/hr - $H_2O$<br>0.0 lb/hr - $SO_2$<br>285,545.4 acfm<br>5.0000% v/v $O_2$ |
| 12 | Furnace/Mixing Chamber/Thermal Oxidizer Radiation and Convection Losses | | | |
| | 200,000 Btu/hr | Same as A | Same as A | Same as A |

TABLE 1-continued

| | Process Flow Diagrams | | | |
|---|---|---|---|---|
| | A<br>FIG. 1 - Prior Art<br>Single Stage | B<br>FIG. 2 - Prior Art<br>Single Stage | C<br>FIG. 3 - Prior Art<br>Single Stage | D<br>FIG. 4<br>Two Stage |
| 13 | Output from Tempering Chamber | | | |
| | 1350.0° F.<br>253,866.9 lb/hr - Total<br>109,908.5 lb/hr - $N_2$<br>9,809.7 lb/hr - $O_2$<br>16,241.2 lb/hr - $CO_2$<br>117,907.5 lb/hr - $H_2O$<br>0.0 lb/hr - $SO_2$<br>254,172.2 acfm | 1350.0° F.<br>266,739.6 lb/hr - Total<br>129,701.2 lb/hr - $N_2$<br>18,069.2 lb/hr - $O_2$<br>14,678.3 lb/hr - $CO_2$<br>104,290.8 lb/hr - $H_2O$<br>0.0 lb/hr - $SO_2$<br>258,050.4 acfm | 1350.0° F.<br>283,061.2 lb/hr - Total<br>137,453.3 lb/hr - $N_2$<br>19,182.9 lb/hr - $O_2$<br>15,532.3 lb/hr - $CO_2$<br>110,892.7 lb/hr - $H_2O$<br>0.0 lb/hr - $SO_2$<br>273,953.2 acfm | 1350.0° F.<br>335,091.1 lb/hr - Total<br>162,718.8 lb/hr - $N_2$<br>22,708.9 lb/hr - $O_2$<br>18,387.3 lb/hr - $CO_2$<br>131,276.1 lb/hr - $H_2O$<br>0.0 lb/hr - $SO_2$<br>324,308.9 acfm |
| 14 | Output from Primary Heat Exchanger | | | |
| | 358.9° F.<br>253,866.9 lb/hr - Total<br>114,970.0 acfm | 358.9° F.<br>266,739.6 lb/hr - Total<br>116,724.2 acfm | 421.0° F.<br>283,061.2 lb/hr - Total<br>133,318.4 acfm | 421.0° F.<br>335.091.1 lb/hr - Total<br>157,823.9 acfm |
| 15 | Heat Exchanger Radiation and Convection Losses | | | |
| | 200,000 Btu/hr | Same as A | Same as A | Same as A |
| 16 | Exhaust Gas Recycle to Tempering Chamber | | | |
| | 358.9° F.<br>36,013.8 lb/hr - Total<br>15,591.7 lb/hr - $N_2$<br>1,391.6 lb/hr - $O_2$<br>2,304.0 lb/hr - $CO_2$<br>16,726.5 lb/hr - $H_2O$<br>0.0 lb/hr - $SO_2$<br>16,309.8 acfm | 358.9° F.<br>6,829.3 lb/hr - Total<br>3,320.7 lb/hr - $N_2$<br>462.6 lb/hr - $O_2$<br>375.8 lb/hr - $CO_2$<br>2,670.1 lb/hr - $H_2O$<br>0.0 lb/hr - $SO_2$<br>2,988.5 acfm | 421.0° F.<br>23,832.4 lb/hr - Total<br>11,572.9 lb/hr - $N_2$<br>1,615.1 lb/hr - $O_2$<br>1,307.7 lb/hr - $CO_2$<br>9,336.6 lb/hr - $H_2O$<br>0.0 lb/hr - $SO_2$<br>11,224.8 acfm | 421.0° F.<br>75,862.3 lb/hr - Total<br>36,838.4 lb/hr - $N_2$<br>5,141.1 lb/hr - $O_2$<br>4,162.8 lb/hr - $CO_2$<br>29,720.0 lb/hr - $H_2O$<br>0.0 lb/hr - $SO_2$<br>35,730.2 acfm |
| 17 | Atmospheric Exhaust | | Exhaust Input to Combustion Air Heater | |
| | 358.9° F.<br>217,853.1 lb/hr - Total<br>94,316.8 lb/hr - $N_2$<br>8,418.1 lb/hr - $O_2$<br>13,937.2 lb/hr - $CO_2$<br>101,181.1 lb/hr - $H_2O$<br>0.0 lb/hr - $SO_2$<br>98,660.2 acfm | 358.9° F.<br>259,910.3 lb/hr - Total<br>126,380.5 lb/hr - $N_2$<br>17,606.6 lb/hr - $O_2$<br>14,302.5 lb/hr - $CO_2$<br>101,620.7 lb/hr - $H_2O$<br>0.0 lb/hr - $SO_2$<br>113,735.7 acfm | 421.0° F.<br>259,228.8 lb/hr - Total<br>122,093.6 acfm | Same as C |
| 18 | Atmospheric Exhaust Out of Combustion Air Heater to Stack | | | |
| | N/A | N/A | 358.9° F.<br>113,479.7 acfm | Same as C |
| 19 | Heated Offgas to Furnace/Mixing Chamber | | | |
| | N/A | N/A | N/A | 700° F.<br>(79.9% of offgas)<br>85,943.2 lb/hr - Total<br>10,974.1 lb/hr - $N_2$<br>3315.4 lb/hr - $O_2$<br>7.1 lb/hr - $CO_2$<br>71,646.6 lb/hr - $H_2O$<br>65,457.5 acfm |

We claim:

1. In a process of reducing the VOC and CO emissions in dryer offgas that is discharged into the atmosphere from a moist organic product dryer and wherein the process includes recuperative thermal oxidizing apparatus having an input of dryer offgas and hot products of combustion from a combination furnace and mixing chamber that produces a hot gaseous output destined for atmospheric discharge, the improved steps of:

a. introducing fuel and combustion air into a burner connected to the combination furnace and mixing chamber;

b. combusting the fuel and combustion air in the combination furnace and mixing chamber;

c. separating the dryer offgas into a first portion and a second portion;

d. directing said first portion of the dryer offgas through the burner to facilitate recirculation of flue gas for NOx reduction, said first portion of dryer offgas being combusted along with the fuel and combustion air in the combination furnace and mixing chamber;

e. bringing said second portion of the dryer offgas into indirect heat exchange relationship with the hot gaseous output from the thermal oxidizing apparatus within a primary heat exchanger to preheat said second portion of the dryer offgas;

f. separating the preheated dryer offgas into a first portion and a second portion;

g. recycling said first portion of preheated dryer offgas back to the dryer;

h. directing said second portion of preheated dryer offgas to the combination furnace and mixing chamber;

I. mixing the first portion of dryer offgas of step d, the second portion of preheated dryer offgas of step h, and the products of combustion of step b, in the combination furnace and mixing chamber;

j. introducing the mixture into the thermal oxidizing apparatus, which increases the temperature of the hot gaseous output from the thermal oxidizing apparatus to a level which significantly decreases the VOC and CO content of said hot gaseous output from the thermal oxidizing apparatus; and k. discharging the hot gaseous output from the thermal oxidizing apparatus to the atmosphere after indirect heat exchange with said preheated second portion of the dryer offgas of step e.

2. The method of claim 1, wherein is included the steps of combining sufficient quantities of the hot products of combustion and said first portion of dryer offgas and said second portion of preheated dryer offgas entering the combination furnace and mixing chamber to increase the temperature of the hot gaseous output from the thermal oxidizing apparatus to a level of at least about 1600° F.

3. The method of claim 2, wherein is included the step of maintaining the thermal oxidizer oxygen concentration at a level of at least about 5% by volume.

4. The method of claim 1, wherein the quantity of said first non-preheated portion of the dryer offgas directed through the burner, as compared to the preheated portion of the dryer offgas directed to the combination furnace and mixing chamber, is selected in order to maximize the weighted average temperature of the dryer offgas entering the thermal oxidation process, thus resulting in the highest possible outlet temperature from the thermal oxidizer.

5. The method of claim 1, wherein is included the step of preheating the second portion of dryer offgas to a temperature of from about 650° F. to about 750° F.

6. The method of claim 1, wherein is included the step of passing the hot gaseous output from the thermal oxidizing apparatus through a tempering chamber to reduce the temperature thereof before the hot gaseous output is brought into indirect heat exchange relationship with said second portion of dryer offgas.

7. The method of claim 6, wherein said tempering step includes separating the hot gaseous output from the tempering chamber into a first portion and second portion after passing said hot gaseous output through the primary heat exchanger, with said first portion being recycled back to the tempering chamber.

8. The method of claim 1, wherein is included the step of introducing the quantities of preheated combustion air and fuel into the burner such that the hot gaseous output from the thermal oxidizing apparatus is raised to a level of at least about 1600° F.

9. In a process of reducing the VOC and CO emissions in dryer offgas that is discharged into the atmosphere from a fermentation byproduct dryer and wherein the process includes recuperative thermal oxidizing apparatus having an input of dryer offgas and hot products of combustion from a combination furnace and mixing chamber that produces a hot gaseous output destined for atmospheric discharge, the improved steps of:

a. introducing fuel and combustion air into a burner connected to the combination furnace and mixing chamber;

b. combusting the fuel and combustion air in the combination furnace and mixing chamber;

c. separating the dryer offgas into a first portion and a second portion;

d. directing said first portion of the dryer offgas through the burner to facilitate recirculation of flue gas for NOx reduction, said first portion of dryer offgas being combusted along with the fuel and combustion air in the combination furnace and mixing chamber;

e. bringing said second portion of the dryer offgas into indirect heat exchange relationship with the hot gaseous output from the thermal oxidizing apparatus within a primary heat exchanger to preheat said second portion of the dryer offgas;

f. separating the preheated dryer offgas into a first portion and a second portion;

g. recycling said first portion of preheated dryer offgas back to the dryer;

h. directing said second portion of preheated dryer offgas to the combination furnace and mixing chamber;

I. mixing the first portion of dryer offgas of step d, the second portion of preheated dryer offgas of step h, and the products of combustion of step b, in the combination furnace and mixing chamber;

j. introducing the mixture into the thermal oxidizing apparatus;

k. controlling the temperature of the hot products of combustion and the relative proportions of the first and second portions of the dryer offgas of step c to provide a resulting increase in the temperature of the hot gaseous output from the thermal oxidizing apparatus to a level that significantly decreases the VOC and CO content of the hot gaseous output from the thermal oxidizing apparatus;

l. discharging the hot gaseous output from the thermal oxidizing apparatus to the atmosphere after indirect heat exchange with said preheated second portion of the dryer offgas of step e.

10. The method of claim 9, wherein is included the steps of combining sufficient quantities of the hot products of combustion and said first portion of dryer offgas and said first portion of preheated dryer offgas entering the combination furnace and mixing chamber to increase the temperature of the hot gaseous output from the thermal oxidizing apparatus to a level of at least about 1600° F.

11. The method of claim 10, wherein is included the step of maintaining the thermal oxidizer oxygen concentration at a level of about 5% by volume.

12. The method as set forth in claim 9, wherein the quantity of the non-preheated portion of the dryer offgas directed through the burner, as compared to the preheated portion of the dryer offgas directed to the combination furnace and mixing chamber, is selected in order to maximize the weighted average temperature of the dryer offgas entering the thermal oxidation process, thus resulting in the highest possible outlet temperature from the thermal oxidizer.

13. The method as set forth in claim 9, wherein is included the step of increasing the temperature of said second portion of dryer offgas to a temperature of from about 650° F. to about 750° F. by heat exchange with the hot gaseous output from the thermal oxidizing apparatus before returning a portion of the recycle offgas to the dryer.

14. The method as set forth in claim 13, wherein is included the step of separating said second portion of dryer offgas into a first portion and a second portion after heat exchange of said second portion of dryer offgas with the hot gaseous output from the thermal oxidizing apparatus.

15. The method as set forth in claim 9, wherein is included the steps of directing said first portion of preheated dryer offgas to the thermal oxidizing apparatus at a temperature of from about 650° F. to about 750° F. and directing the first portion of dryer offgas to the thermal oxidizing apparatus at a temperature of from about 200° F. to about 250° F.

16. The method of claim 9, wherein the preheated and non-preheated portions of dryer offgas directed to the thermal oxidizing apparatus have a weighted average temperature of from about 600° F. to about 650° F.

17. The method of claim 9, wherein is included the step of passing the hot gaseous output from the thermal oxidizing apparatus through a tempering chamber to reduce the temperature thereof before the hot gaseous output is brought into indirect heat exchange relationship with said second portion of dryer offgas.

18. The method of claim 17, wherein said tempering step includes separating the hot gaseous output from the tempering chamber into a first portion and second portion after passing said hot gaseous output through the primary heat exchanger, with said first portion being recycled back to the tempering chamber.

19. The method of claim 9, wherein is included the step of preheating the second portion of dryer offgas to a temperature of from about 650° F. to about 750° F.

20. Two-stage equipment for reducing the VOC and CO content of dryer offgas that is discharged into the atmosphere from a moist organic product drying process, which includes a dryer having a hot gas inlet and an offgas outlet and adapted to receive a moist product to be dried and to discharge the dried product, a gas-to-gas heat exchanger of the indirect type having a hot gas side and a cool gas side, herein referred to as the primary heat exchanger, fans to provide the motive forces for moving the gaseous products into and through and out of the equipment, means of controlling the flow rate of the gaseous products, which can be dampers and/or variable speed adaptions to the fans, gravity-type and/or centrifugal-type and/or cyclonic-type separators for separating the solid products from the gaseous products, and conveyors for moving solid products into, through and out of the system comprising:

a. thermal oxidizing apparatus including a thermal oxidizer having an input and an output, a combination furnace and mixing chamber operably connected to the input of the thermal oxidizer, a burner, and a tempering chamber that communicates with the thermal oxidizer and primary heat exchanger;

b. a duct leading from the gas outlet of the dryer to the cool gas side inlet plenum of the primary heat exchanger and including a separator, a fan and means for controlling the flow rate of the gaseous products;

c. a duct leading from the cool gas side inlet plenum of the primary heat exchanger to the burner for directing a portion of dryer offgas through the burner and including a fan and a means of controlling the flow rate of the gaseous products;

d. a duct leading from the cool gas side outlet plenum of the primary heat exchanger to the hot gas inlet of the dryer;

e. a duct leading from the cool gas side outlet plenum of the primary heat exchanger to the combination furnace and mixing chamber and including a fan and a means of controlling the flow rate of the gaseous products;

f. a duct leading from the hot gas outlet of the thermal oxidizer to the tempering chamber;

g. a duct leading from the tempering chamber to the hot gas side inlet plenum of the primary heat exchanger;

h. a duct leading from the hot gas side outlet plenum of the primary heat exchanger to the tempering chamber and including a fan and a means of controlling the flow rate of the gaseous products;

i. a duct leading from the hot gas side outlet plenum of the primary heat exchanger to the atmosphere for discharging offgas having reduced VOC and CO content to the atmosphere and including a fan and a means of controlling the flow rate of the gaseous products; and j. structure selected from the group consisting of:

i. an indirect gas-to-gas heat exchanger for the purpose of transferring heat from the hot gaseous output destined for atmospheric discharge to combustion air destined for use in the burner, ii. a combustion air shroud around the furnace and/or mixing chamber to capture heat into the combustion air, which heat would otherwise be lost to the environment, iii. a product cooler to cool the hot product discharged from the dryer, iv. a product cooler using atmospheric air as the cooling media, and after passing through the cooler, the atmospheric air is utilized as combustion air for the burner, and v. a bag house for separating entrained particulate matter from the atmospheric air used as the cooling media in a direct-contact product cooler.

21. Equipment as set forth in claim 20, wherein a tempering chamber is interposed between the thermal oxidizer and the hot gas side inlet plenum of the primary heat exchanger, that is, at the common junction of ducts f, g, and h.

22. Equipment as set forth in claim 20, wherein a mixing chamber is interposed between the furnace and the thermal oxidizer for the purpose of mixing the products of combustion from the furnace and the preheated dryer offgas.

* * * * *